US005979656A

United States Patent [19]

Northcott et al.

[11] Patent Number: 5,979,656

[45] Date of Patent: Nov. 9, 1999

[54] TACO HOLDING TRAY

[76] Inventors: Arthur R. Northcott; Tony Korosak, both of 1977 Silverberry Crescent, Mississauga, Canada, L5J 1C8

[21] Appl. No.: 09/070,647

[22] Filed: Apr. 30, 1998

[51] Int. Cl.[6] ..... B65D 1/36; A47G 19/32

[52] U.S. Cl. ..... 206/564; 211/85.4; 312/284; 426/115

[58] Field of Search ..... D7/504, 555, 586; 248/174; 211/85.4, 60.1; 312/284; 426/115; 206/557, 564; 220/23.8

[56] References Cited

U.S. PATENT DOCUMENTS

| | | | |
|---|---|---|---|
| D. 221,883 | 9/1971 | Cash | 220/23.8 X |
| D. 364,537 | 11/1995 | Anderson | D7/555 X |
| D. 368,409 | 4/1996 | Schwartz | D7/555 X |
| 519,417 | 5/1894 | York | 312/284 X |
| 947,373 | 1/1910 | Coleman, Sr. | D7/505 X |
| 2,703,185 | 3/1955 | Cook | 220/23.8 |
| 3,057,671 | 10/1962 | Formar | 312/284 X |
| 3,179,320 | 4/1965 | Ward | 206/564 |
| 4,874,083 | 10/1989 | Antoni et al. | 206/564 X |

*Primary Examiner*—Bryon P. Gehman

[57] ABSTRACT

A new taco holding tray for holding tacos and taco condiments. The inventive device includes an annular base having a top, a bottom, an inner perimeter, and an outer perimeter. The inner perimeter of the annular base defines a center hole. The annular base has a plurality of spaced apart radial grooves extending radially outwards from the inner perimeter of the annular base to the outer perimeter of the annular base. Each of the radial grooves has an upper opening formed at the top of the annular base.

11 Claims, 2 Drawing Sheets

TACO HOLDING TRAY

BACKGROUND OF THE INVENTION

1. Field of the Invention

The present invention relates to serving trays, in particular, serving trays for tacos and more particularly pertains to a new taco holding tray for holding tacos and taco condiments.

2. Description of the Prior Art

The use of serving trays, in particular, serving trays for tacos is known in the prior art. More specifically, serving trays, in particular, serving trays for tacos heretofore devised and utilized are known to consist basically of familiar, expected and obvious structural configurations, notwithstanding the myriad of designs encompassed by the crowded prior art which have been developed for the fulfillment of countless objectives and requirements.

Known prior art serving trays, in particular, serving trays for tacos include U.S. Pat. No. 4,004,501; U.S. Pat. No. 4,362,247; U.S. Pat. No. Des. 284,341; U.S. Pat. No. 2,964,175; U.S. Pat. No. 1,596,716; and U.S. Pat. No. 4,573,579.

While these devices fulfill their respective, particular objectives and requirements, the aforementioned patents do not disclose a new taco holding tray. The inventive device includes an annular base having a top, a bottom, an inner perimeter, and an outer perimeter. The inner perimeter of the annular base defines a center hole. The annular base has a plurality of spaced apart radial grooves extending radially outwards from the inner perimeter of the annular base to the outer perimeter of the annular base. Each of the radial grooves has an upper opening formed at the top of the annular base.

In these respects, the taco holding tray according to the present invention substantially departs from the conventional concepts and designs of the prior art, and in so doing provides an apparatus primarily developed for the purpose of holding tacos and taco condiments.

SUMMARY OF THE INVENTION

In view of the foregoing disadvantages inherent in the known types of serving trays, in particular, serving trays for tacos now present in the prior art, the present invention provides a new taco holding tray construction wherein the same can be utilized for holding tacos and taco condiments.

The general purpose of the present invention, which will be described subsequently in greater detail, is to provide a new taco holding tray apparatus and method which has many of the advantages of the serving trays, in particular, serving trays for tacos mentioned heretofore and many novel features that result in a new taco holding tray which is not anticipated, rendered obvious, suggested, or even implied by any of the prior art serving trays, in particular, serving trays for tacos, either alone or in any combination thereof.

To attain this, the present invention generally comprises an annular base having a top, a bottom, an inner perimeter, and an outer perimeter. The inner perimeter of the annular base defines a center hole. The annular base has a plurality of spaced apart radial grooves extending radially outwards from the inner perimeter of the annular base to the outer perimeter of the annular base. Each of the radial grooves has an upper opening formed at the top of the annular base.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new taco holding tray apparatus and method which has many of the advantages of the serving trays, in particular, serving trays for tacos mentioned heretofore and many novel features that result in a new taco holding tray which is not anticipated, rendered obvious, suggested, or even implied by any of the prior art serving trays, in particular, serving trays for tacos, either alone or in any combination thereof.

It is another object of the present invention to provide a new taco holding tray which may be easily and efficiently manufactured and marketed.

It is a further object of the present invention to provide a new taco holding tray which is of a durable and reliable construction.

An even further object of the present invention is to provide a new taco holding tray which is susceptible of a low cost of manufacture with regard to both materials and labor, and which accordingly is then susceptible of low prices of sale to the consuming public, thereby making such taco holding tray economically available to the buying public.

Still yet another object of the present invention is to provide a new taco holding tray which provides in the apparatuses and methods of the prior art some of the advantages thereof, while simultaneously overcoming some of the disadvantages normally associated therewith.

Still another object of the present invention is to provide a new taco holding tray for holding tacos and taco condiments.

Yet another object of the present invention is to provide a new taco holding tray which includes an annular base having a top, a bottom, an inner perimeter, and an outer perimeter. The inner perimeter of the annular base defines a center hole. The annular base has a plurality of spaced apart radial grooves extending radially outwards from the inner perimeter of the annular base to the outer perimeter of the annular base. Each of the radial grooves has an upper opening formed at the top of the annular base.

Still yet another object of the present invention is to provide a new taco holding tray that holds taco shells for permitting filling and preparation of tacos and also permits storage of prepared tacos.

Even still another object of the present invention is to provide a new taco holding tray that may be constructed to be microwavable and oven safe so that tacos may be prepared and served all on one tray.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
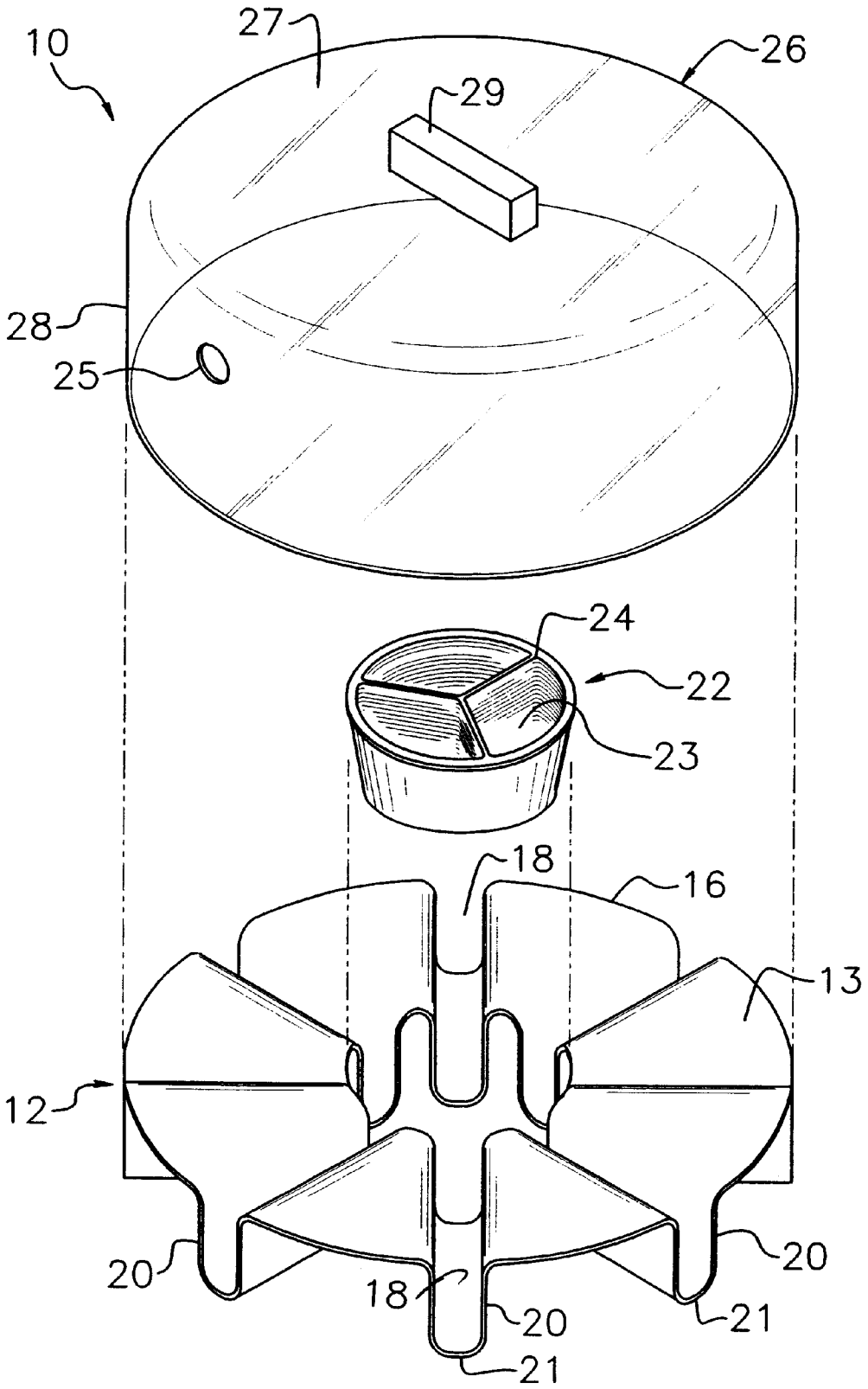
FIG. 1 is a schematic exploded perspective view of a new taco holding tray according to the present invention.
Figure 2:
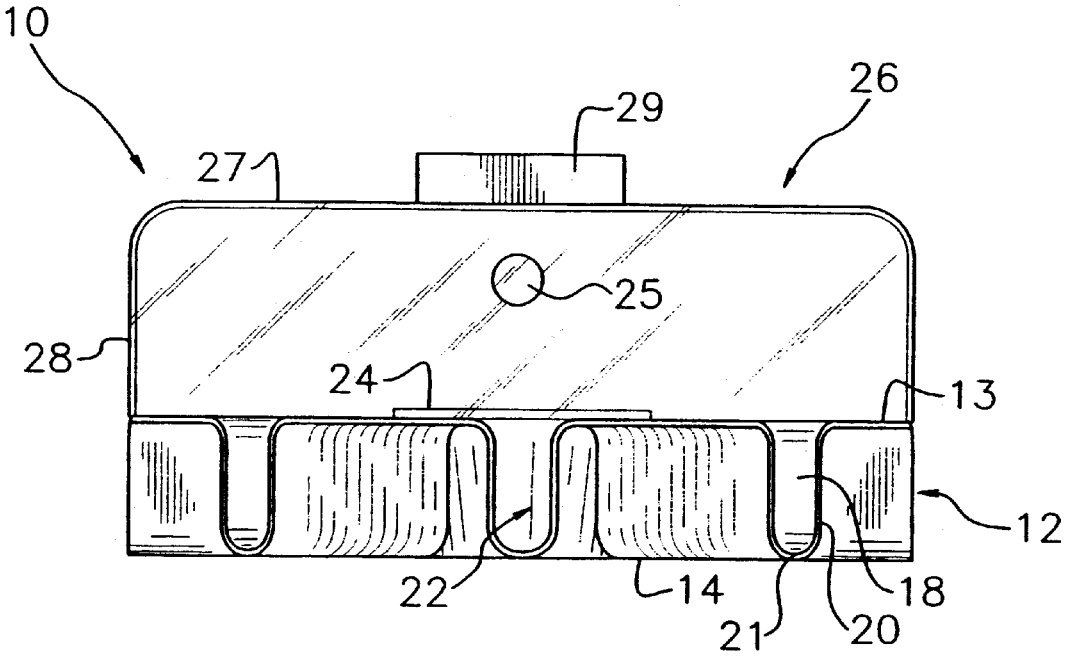
FIG. 2 is a schematic side view of the present invention.
Figure 3:
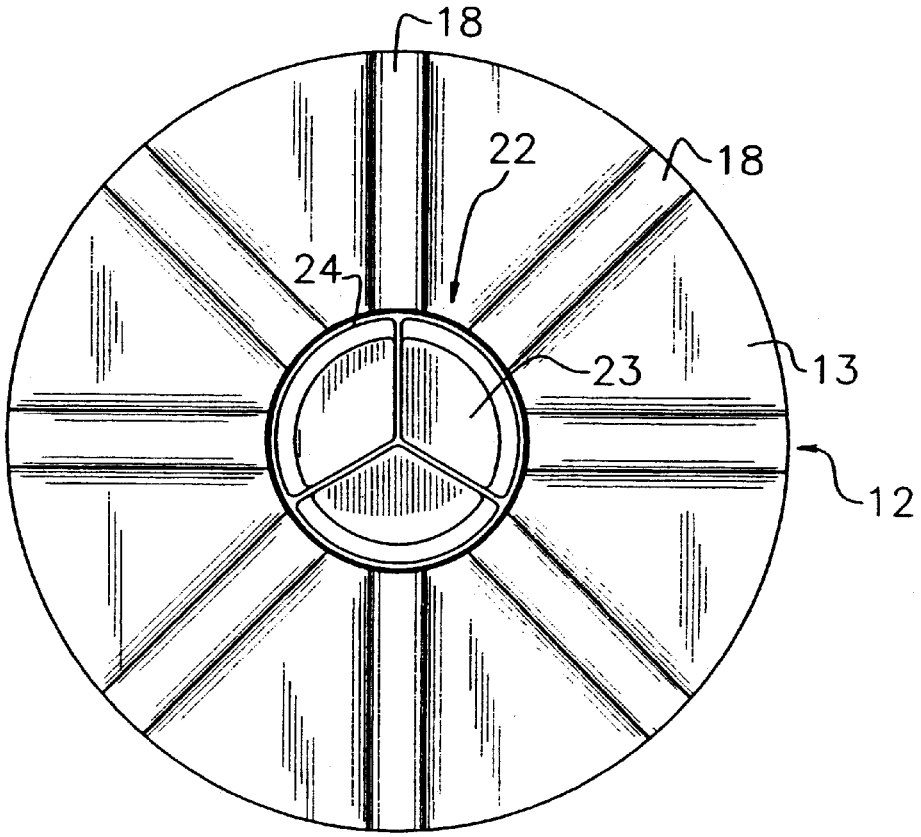
FIG. 3 is a schematic top side view of the annular base of the present invention.

With reference now to the drawings, and in particular to FIGS. 1 through 3 thereof, a new taco holding tray embodying the principles and concepts of the present invention and generally designated by the reference numeral 10 will be described.

As best illustrated in FIGS. 1 through 3, the taco holding tray 10 generally comprises an annular base 12 having a top 13, a bottom 14, an inner perimeter 15, and an outer perimeter 16. The inner perimeter 15 of the annular base 12 defines a center hole. The annular base 12 has a plurality of spaced apart radial grooves 18 extending radially outwards from the inner perimeter 15 of the annular base 12 to the outer perimeter 16 of the annular base 12. Each of the radial grooves 18 has an upper opening formed at the top of the annular base 12.

In closer detail, the an annular base 12 has a top, a bottom, an inner perimeter 15, and an outer perimeter 16. The inner perimeter 15 of the annular base 12 defining a center hole. The annular base 12 has a plurality of spaced apart radial groove extending radially outwards from the inner perimeter 15 of the annular base 12 to the outer perimeter 16 of the annular base 12. Each of the radial grooves 18 has an upper opening formed at the top 13 of the annular base 12. Each of the radial grooves 18 is designed for holding a taco therein. Preferably, the annular base 12 has a plurality of radial folds 20 so that each of the radial grooves 18 is defined by an associated radial fold 20. Each of the radial folds 20 has a generally U-shaped cross section and extends, like the radial grooves, radially outwards from the inner perimeter 15 of the annular base 12 to the outer perimeter 16 of the annular base 12. Each of the radial folds 20 has an arcuate root 21 located at the bottom 14 of the annular base 12 and a pair of spaced apart side walls connected by the arcuate root 21. The arcuate roots 21 of the radial folds 20 are designed for functioning as feet for resting the annular base 12 on a surface.

Ideally, the annular base 12 has an outer diameter is defined across the outer perimeter 16 of the annular base 12 of less than about 16 inches, although any size of base 12 may be constructed as needed. In the ideal embodiment, the annular base 12 has a width defined between the inner perimeter 15 of the annular base 12 and the outer perimeter 16 of the annular base of less than about 5¼ inches. Ideally, the radial grooves 18 each have a width is defined between the side walls of its respective radial fold of less than about 1 ¼ inches so that a taco shell may be held in the annular groove.

Preferably, the tray 10 includes a center dish 22 which is generally circular and preferably has plurality of compartments 23 and an circular radial lip 24 extending therearound. The center dish 22 is disposed in the center hole formed by the annular base 12 with the radial lip 24 of the center dish 22 resting on the top 13 of the annular base 12. The compartments 23 are designed for containing condiments for tacos, such as sour cream, cheese, and salsa, therein.

Also in the preferred embodiment, a lid 26 in included. The lid 26 is preferably generally transparent and has a top 27 and lower peripheral side wall 28. The top 27 of the lid 26 is generally circular and has an outer periphery. The peripheral side wall 28 extends around the outer periphery of the top 27 of the lid 26 and is rested on the top 13 of the annular base 12 such that the lid 26 substantially covers the top 13 of the annular base 12. Ideally, the outer diameter of the lid 26 is generally equal to the outer out diameter of the annular base 12. The top of the lid 26 preferably has a handle 29 extended therefrom. Also, the peripheral side wall 28 of the lid 26 has an aperture 25 therethrough which is designed for permitting steam to pass therethrough.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tray, comprising:

an annular base having a top, a bottom, an inner perimeter, and an outer perimeter, said inner perimeter of said annular base defining a center hole; and said annular base having a plurality of spaced apart radial grooves extending radially outwards from said inner perimeter of said annular base to said outer perimeter of said annular base, each of said radial grooves having an upper opening formed at said top of said annular base;

wherein said annular base has a plurality of radial folds, each of said radial grooves being defined by an associated radial fold, each of said radial folds having a uniform generally U-shaped cross section along a length thereof with a height which is greater than a width thereof, said radial folds extending radially outwards from said inner perimeter of said annular base to said outer perimeter of said annular base, each of said radial folds having a root located at said bottom of said annular base, said roots of said radial folds being for resting on a surface, said radial folds having upper edges integrally connected via substantially triangular pieces.

2. The tray of claim 1, wherein said annular base has a plurality of radial folds, each of said radial grooves being defined by an associated radial fold, each of said radial folds each having a generally U-shaped cross section, said radial folds extending radially outwards from said inner perimeter of said annular base to said outer perimeter of said annular base, each of said radial folds having a root located at said bottom of said annular base, said roots of said radial folds being for resting on a surface.

3. The tray of claim 1, wherein said annular base has an outer diameter being defined across said outer perimeter of said annular base, wherein said outer diameter of said annular base is less than 16 inches.

4. The tray of claim 1, wherein said annular base has a width defined between said inner perimeter of said annular base and said outer perimeter of said annular base, wherein said width of said annular base is less than 5¼ inches.

5. The tray of claim 1, further comprising a center dish having an radial lip extending therearound, said center dish being disposed in said center hole, said radial lip of said center dish being rested on said top of said annular base.

6. The tray of claim 5, wherein a center dish is generally circular and has a plurality of compartments.

7. The tray of claim 1, further comprising a lid having a top and lower peripheral side wall, said top of said lid having an outer periphery, said peripheral side wall extending around said outer periphery of said top of said lid, said peripheral side wall of said lid being rested on said top of said annular base such that said lid substantially covers said top of said annular base.

8. The tray of claim 7, wherein said lid is generally transparent, and said top of said lid is generally circular.

9. The tray of claim 7, wherein said top of said lid has a handle being extended therefrom.

10. The tray of claim 7, wherein said peripheral side wall of said lid has an aperture therethrough.

11. A tray for holding tacos, comprising:

an annular base constructed from a material with a uniform thickness along an entirety thereof having a top, a bottom, an inner perimeter, and an outer perimeter, said inner perimeter of said annular base defining a center hole;

said annular base having a plurality of spaced apart radial grooves extending radially outwards from said inner perimeter of said annular base to said outer perimeter of said annular base, each of said radial grooves having an upper opening formed at said top of said annular base;

said annular base having a plurality of radial folds, each of said radial grooves being defined by an associated radial fold, each of said radial folds having a uniform generally U-shaped cross section along a length thereof with a height which is greater than a width thereof, said radial folds extending radially outwards from said inner perimeter of said annular base to said outer perimeter of said annular base, each of said radial folds having a root located at said bottom of said annular base, said roots of said radial folds being for resting on a surface, said radial folds having upper edges integrally connected via substantially planar triangular pieces;

wherein said annular base has an outer diameter being defined across said outer perimeter of said annular base, wherein said outer diameter of said annular base is less than 16 inches;

wherein said annular base has a width defined between said inner perimeter of said annular base and said outer perimeter of said annular base, wherein said width of said annular base is less than 5¼ inches;

a center dish being generally circular and having plurality of compartments and an radial lip extending therearound, said center dish being disposed in said center hole, said radial lip of said center dish being rested on said top of said annular base;

a lid being generally transparent and having a top and lower peripheral side wall, said top of said lid being generally circular and having an outer periphery, said peripheral side wall extending around said outer periphery of said top of said lid, said peripheral side wall of said lid being rested on said top of said annular base such that said lid substantially covers said top of said annular base;

said top of said lid having a substantially rectilinear handle being extended therefrom; and said peripheral side wall of said lid having an aperture therethrough.

* * * * *